US008096023B2

(12) United States Patent
Orza

(10) Patent No.: US 8,096,023 B2
(45) Date of Patent: Jan. 17, 2012

(54) BUTTON COMPOSED OF THREE COOPERATING ELEMENTS

(75) Inventor: Pasquale Orza, Sant'Omero (IT)

(73) Assignee: Jonny Q Italia S.R.L., Sant 'Omero (IT)

( * ) Notice: Subject to any disclaimer, the term of this patent is extended or adjusted under 35 U.S.C. 154(b) by 385 days.

(21) Appl. No.: 12/309,519

(22) PCT Filed: Jul. 11, 2007

(86) PCT No.: PCT/IT2007/000494

§ 371 (c)(1),
(2), (4) Date: Jan. 16, 2009

(87) PCT Pub. No.: WO2008/010254

PCT Pub. Date: Jan. 24, 2008

(65) Prior Publication Data

US 2009/0205171 A1 Aug. 20, 2009

(30) Foreign Application Priority Data

Jul. 17, 2006 (IT) ..... MC20060026 U

(51) Int. Cl.
*A44B 1/28* (2006.01)

(52) U.S. Cl. ..... 24/104; 24/105; 24/109; 24/95

(58) Field of Classification Search ..... 24/104, 24/105, 109, 94, 95, 96
See application file for complete search history.

(56) References Cited

U.S. PATENT DOCUMENTS

| | | | | |
|---|---|---|---|---|
| 2,814,047 | A * | 11/1957 | Lev | 2/195.1 |
| 3,440,692 | A * | 4/1969 | Pomerantz | 24/108 |
| 3,725,979 | A * | 4/1973 | Otsuru | 24/105 |
| 4,458,383 | A * | 7/1984 | Hwang | 24/3.5 |
| 4,782,558 | A * | 11/1988 | Sparrow | 24/114.1 |
| 5,010,625 | A * | 4/1991 | Joyer | 24/90.1 |
| 5,137,483 | A * | 8/1992 | Nealy | 441/75 |
| 2003/0056339 | A1 * | 3/2003 | Kolakovic | 24/104 |
| 2006/0156518 | A1 * | 7/2006 | Frank | 24/104 |

* cited by examiner

*Primary Examiner* — Robert Sandy
*Assistant Examiner* — Rowland D Do
(74) *Attorney, Agent, or Firm* — Lowe Hauptman Ham & Berner, LLP

(57) ABSTRACT

A button having three cooperating elements, 1) a traditional rivet, whose pin is engaged and held inside a corresponding housing centrally on the back of 2) a cylindrical joint with enlarged head, which is frontally provided with a central cylindrical conduit receiving a shank that centrally protrudes from the back of 3) a button head.

1 Claim, 1 Drawing Sheet

BUTTON COMPOSED OF THREE COOPERATING ELEMENTS

BACKGROUND OF THE INVENTION (1) Field of the Invention

The present patent application relates to a button composed of three cooperating elements.

The present invention is intended to improve a known technology that refers to a specific type of buttons that are riveted, and not sewn, on clothing items.

More precisely, reference is made to buttons used for jeans and other clothing garments.

A typical button of this kind is composed of two cooperating elements, the first one being a button provided on the back with a short central shank with axial conduit, and the second one being a traditional rivet, meaning a metal disk from which a sort of pin protrudes from the front and is inserted and riveted inside the shank on the back of the button.

Evidently, the rivet is positioned on the back of the fabric, while the button is positioned on the front of the fabric, it being provided that the pin of the rivet perforates the fabric and permanently engages with the rear shank of the button.

Although it is largely popular, the said technology is characterised by a significant practical disadvantage.

This limitation specifically refers to the irreversible mounting of this type of buttons on clothing garments, due to the fact that the user is not in a position to uncouple the two traditional elements of a rivet button or make a new coupling.

So far, this limitation has not been resulted in a great inconvenience so far, however, this has changed lately because of the tendency to consider buttons as real ornamental elements of clothing items.

As a matter of fact, buttons tend to have sophisticated shapes, are made of valuable, delicate materials and are used to support pearls, strass and gems on the front.

The delicate structure of these buttons is not able to withstand the energetic washing, especially in a washing machine, of the clothing items.

During washing, valuable buttons of this type are subjected to a high risk of irreversible damage.

(2) Description of Related Art

WO01/70066 discloses a button assembly comprising three parts: a rivet, a thread shaft and a two-headed rape protection button.

DE 87 15 300 discloses a button assembly comprising three parts, wherein a rivet is disposed between a shank and a button.

U.S. Pat. No. 2,118,561 discloses a rivet to permanently secure a button to a garment.

U.S. Pat. No. 3,440,692 discloses a quick attachable button which provides a removable prong to irremovably attach a sleeve to a cloth.

BRIEF SUMMARY OF THE INVENTION

The specific purpose of the present invention is to allow for easy dismounting (and new mounting) or a rivet button from clothing items for the first time.

In such a case, the owner of the clothing item is finally able to remove the "valuable" buttons before washing and mount them again on the clothing item at the end of the washing cycle, thus avoiding all risks of damage.

Moreover, it must be noted that the possibility to remove and remount a rivet button from a clothing item is also appreciated for other practical reasons: first of all, to replace broken or damaged buttons and also to change them as desired for customization purposes.

As a matter of fact, the user may decide to use different buttons, of different colours and with different ornaments or finishes, to replace the buttons used for a specific item by the clothing manufacturer.

The inventive idea of the present invention is to conceive a button assembly as the combination of three, and not two, cooperating elements.

In particular, the first element of the button assembly of the invention consists in a traditional rivet, normally positioned on the back of the clothing item.

The second element, that is to say the most innovative one, is placed between the rivet and the third element of the invention consisting in a proper button provided with a shank without axial hole on the back.

The second element is a joint mounted on the front of the clothing item, which is simultaneously connected both with the traditional rivet and with the shank provided on the back of the proper button.

It must be noted that the connection between the cylindrical joint and the rivet is obtained with traditional means (i.e. irreversibly), since the same joint is provided with a rear conduit able to receive exactly the pin that protrudes frontally from the rivet.

The connection between the front end of the joint and the shank on the back of the proper button is easily removable (i.e. screw, snap, bayonet, etc.).

Because of this, the user can easily dismount the button from the joint, before washing the clothing item, in order to ensure the button integrity. On the other hand, although they remain attached to the clothing item during washing, the rivet and joint are not subjected to any risk of damage.

The easy, rapid dismounting of the button from the joint is also appreciated when the user intends to replace the button with another button having different aesthetic and ornamental features, having the same rear shank designed to cooperate with the aforementioned joint.

For purposes of clarity the description of the invention continues with reference to the enclosed drawing, which is intended for purposes of illustration only and not in a limiting sense, whereby:

DETAILED DESCRIPTION OF THE INVENTION

Figure 1:
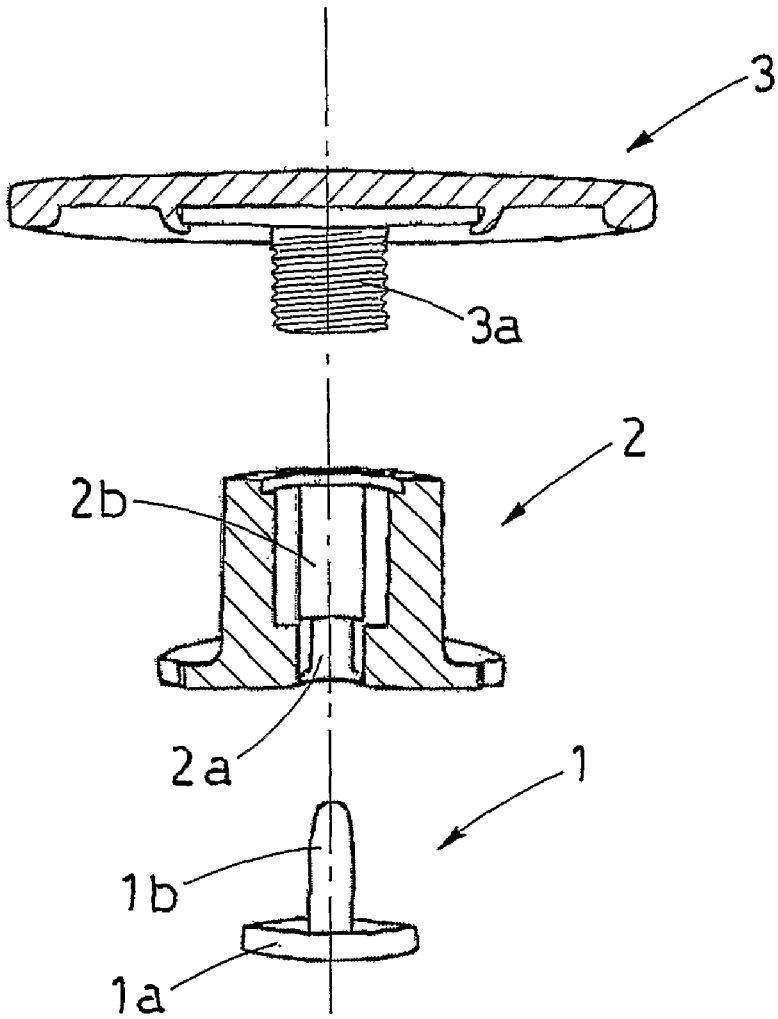
FIG. 1 is a view of the three partially sectioned elements of the button assembly of the invention before mounting.
Figure 2:
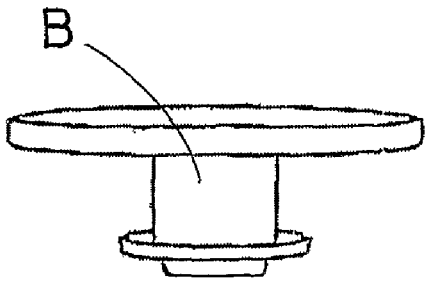
FIG. 2 is an axonometric view of the same button assembly after mounting.

With reference to the said figures, the new button assembly (B) of the invention is composed of three cooperating elements (1, 2, 3).

The first element (1) consists in a rivet, normally provided with a circular head (1*a*), from which a pin (1*b*) protrudes frontally in central position.

As mentioned earlier, the rivet (1) is positioned on the back of the fabric, in such a way the pin (1*b*) perforates the fabric, coming out from the front.

The pin (1*b*) is engaged and permanently riveted inside a small housing (2*a*) in central position on the back of a cylindrical joint with enlarged head (2) positioned on the front of the fabric.

The joint (2) is frontally provided with a central cylindrical conduit (2*b*) that receives a shank (3*a*) centrally protruding from the back of a proper button (3).

As mentioned earlier, mutual coupling can be ensured by means of screw connection, as shown in FIG. 1; in such a case, the internal walls of the conduit (2*b*) of the joint (2) are provided with thread suitable to the external thread of the shank (3*a*) of the proper button (3).

Alternatively, bayonet or snap coupling can be provided, being necessary in such a case to provide traditional cooperating means (of known type) both on the conduit (2*b*) of the joint (2) and on the shank (3*a*) of the button (3).

The invention claimed is:

1. A button assembly to be used on fabric in a clothing item, the button assembly being composed of three cooperating elements comprising:

a rivet (1) positioned on the back of the clothing item and provided with a circular head (1*a*), from which a pin (1*b*) protrudes, a cylindrical joint with an enlarged head (2) mounted on the front of the clothing item and provided with a corresponding housing (2*a*), in central position on the back of the enlarged head, inside which said pin (1*b*) of the rivet is engaged and held, in a relationship of irreversible coupling, and a proper button (3) provided with a shank (3*a*) which centrally protrudes from the back of the button, said shank (3*a*) of the proper button is without an axial hole, and said cylindrical joint (2) has a front having a central cylindrical conduit (2*b*) formed thereon, said cylindrical conduit receives said shank (3*a*) of the proper button (3) wherein said removable coupling of the shank (3*a*) of the proper button (3) inside the front cylindrical conduit (2*b*) of the joint (2) is formed by coupling between a thread on the external walls of the shank (3*a*) and a cooperating thread on the internal walls of the conduit (2*b*).

* * * * *